US005570797A

United States Patent [19]

Yeh

[11] Patent Number: 5,570,797

[45] Date of Patent: Nov. 5, 1996

[54] MUG AND MULTIPURPOSE LID COMBINATION

[76] Inventor: Frank Yeh, 1019 N. Mayflower St., Anaheim, Calif. 92801

[21] Appl. No.: 398,915

[22] Filed: Mar. 6, 1995

[51] Int. Cl.[6] ..... A47G 19/22

[52] U.S. Cl. ..... 215/228; 215/392; 220/710.5; 220/713

[58] Field of Search ..... 220/253, 703, 220/710.5, 711, 715, 716, 719, 771, 212, 212.5, 630, 631, 632; 215/392, 393, 394, 387, 386, 228; 222/485, 572, 522; 270/288, 296

[56] References Cited

U.S. PATENT DOCUMENTS

| | | | |
|---|---|---|---|
| D. 245,384 | 8/1977 | Ashton | 215/228 X |
| 2,437,784 | 9/1944 | Laskin . | |
| 2,707,574 | 6/1952 | Klebenow . | |
| 3,105,621 | 4/1962 | Francis . | |
| 3,140,799 | 7/1964 | Mehr . | |
| 3,469,739 | 9/1969 | Phillips | 222/485 |
| 3,598,271 | 8/1971 | Holley | 215/228 X |
| 3,915,355 | 10/1975 | Young . | |
| 4,303,170 | 12/1981 | Panicci . | |
| 4,544,063 | 10/1985 | Neward | 220/253 X |
| 4,582,218 | 4/1986 | Ross . | |
| 4,986,437 | 1/1991 | Farmer . | |
| 5,018,636 | 5/1991 | Ross . | |
| 5,102,000 | 4/1992 | Feltman III . | |
| 5,123,558 | 6/1992 | Moloney | 220/212 |
| 5,143,248 | 9/1992 | Sawatsky . | |
| 5,150,816 | 9/1992 | DeCastro | 220/711 |
| 5,158,180 | 10/1992 | Zucker | 220/253 X |
| 5,217,141 | 6/1993 | Ross . | |
| 5,249,703 | 10/1993 | Karp . | |
| 5,273,182 | 12/1993 | Laybourne | 215/394 X |
| 5,310,074 | 5/1994 | Jochem et al. | 220/296 |
| 5,368,186 | 11/1994 | Yeh . | |
| 5,372,275 | 12/1994 | Yeh . | |
| 5,419,154 | 5/1995 | Christoff | 220/713 X |
| 5,454,482 | 10/1995 | Simon | 220/713 |

*Primary Examiner*—Gary E. Elkins
*Assistant Examiner*—Nathan Newhouse
*Attorney, Agent, or Firm*—Raymond Sun

[57] ABSTRACT

A drinking mug and multipurpose lid combination comprises a lid comprising a substantially cylindrical side wall having an inner surface, and at least one locking member provided on the inner surface. The combination further comprises a mug comprising a substantially cylindrical body, an annular shoulder at the upper end of the cylindrical body, and a recessed cylindrical wall at the inner edge of the annular shoulder. The mug further comprises at least one retaining bar provided on the outer surface of the recessed cylindrical wall. The inner surface of the cylindrical side wall of the lid is adapted to be positioned adjacent the outer surface of the recessed cylindrical wall of the mug when the lid is used to cover the mouth of the mug. When in this position, the lid is adapted to be rotated in a first direction so that each locking member of the lid is retained below each corresponding retaining bar of the mug to secure the lid to the mug.

20 Claims, 5 Drawing Sheets

MUG AND MULTIPURPOSE LID COMBINATION

BACKGROUND OF THE INVENTION

1. Field of the Invention

The present invention relates to a unique combined mug and multipurpose lid, and in particular, to a mug and lid combination in which the lid is provided with mechanisms for securely retaining the lid at the external surface of the mouth of the mug to effectively seal the mouth of the mug and prevent spillage of the liquid contained therein. The multipurpose lid may also be adapted for use as a coaster for the mug.

2. Description of the Related Art

The present invention is applicable to mugs, cups and beverage containers alike, which shall hereinafter be collectively referred to as "mugs".

There are many lids that have been provided for use with mugs. These lids perform two primary functions: (1) to cover the open mouth of the mug to prevent the liquid contained in the mug from spilling, and (2) to maintain the temperature of hot liquid in the mug by preventing the escape of steam. It is expected that such safety lids be provided at low cost.

Many of the currently-available lids suffer from a number of drawbacks, the most serious being that these lids are not securely retained at the mouth of the mug, which allows spillage of the liquid if the mug is tipped over. Some of these lids also make it inconvenient for a user to drink from the mug, since an insecure lid usually means that the user must hold the lid while drinking.

Several attempts have been made to address this drawback. For example, lids that were snap-fitted over the external surface of the mouth of the mug were provided. One such example is illustrated in U.S. Pat. No. 4,986,437 to Farmer, which discloses a cup having a lip rim which is adapted to be snap-fitted into an annulus defined by a cylindrical wall of the lid. Such lids are not convenient to use because the user must exert significant force to snap the lid in place at the rim of the cup or mug, or to remove the lid therefrom, which can be troublesome if the mug or cup has been filled with liquid. Moreover, snap-fit lids are generally unreliable since they must be entirely snapped in place to be effective.

There have also been attempts to provide lids that are specifically adapted for use with specific mugs. Most of these attempts provide a lid that carries one or more securing elements or mechanisms that are adapted to be secured to or engaged with grooves, indentations, channels or corresponding attachment elements provided on an internal surface of a specific mug. Such examples are illustrated and described in U.S. Pat. Nos. 4,582,218 to Ross, 5,018,636 to Ross, 5,102,000 to Feltman, III, 5,217,141 to Ross, 5,249,703 to Karp and 5,372,275 to Yeh. Thus, a specific mug and lid combination must be provided. A drawback experienced by such lids is that they typically require precise interaction between the corresponding elements of the mug and the lid. Since the nature of ceramic or porcelain makes it difficult to manufacture ceramic or porcelain mugs to meet precise sizes and shapes, the lids may be difficult to use with such mugs. Additionally, some of these lids contain fragile elements that may affect the durability of the lid. For example, the Ross '636, Feltman and Karp patents describe the use of rods, fingers or arms that are easily breakable after extended or rough use. This increases the cost to the user who must then replace the defective lids, or be left with a mug that cannot be used with a different lid.

Thus, there remains a need for a mug and lid combination that is easy to use, can be provided at low cost, and which effectively secures the lid to the mouth of the mug to prevent spillage.

SUMMARY OF THE INVENTION

The objects of the present invention may be achieved by providing a mug and lid combination. The combination comprises a lid comprising a substantially cylindrical side wall having an inner surface, and at least one locking member provided thereon. The combination further comprises a mug comprising a substantially cylindrical body, an annular shoulder at the upper end of the cylindrical body having an inner edge, and a recessed cylindrical wall at the inner edge of the annular shoulder. The recessed cylindrical wall has an outer surface and its diameter is less than that of the cylindrical body. The mug further comprises at least one retaining bar provided on the outer surface of the recessed cylindrical wall. The inner surface of the cylindrical side wall of the lid is adapted to be positioned adjacent the outer surface of the recessed cylindrical wall when the lid is used to cover the mouth of the mug. When so positioned, the lid is adapted to be rotated in a first direction so that the each locking member of the lid is retained below each corresponding retaining bar of the mug to secure the lid to the mug.

In addition, each retaining bar of the mug is angled and comprises an upper edge and a lower edge. The lower edge of each retaining bar acts to stop advancement of the corresponding locking member of the lid in the first direction when such locking member abuts the lower edge of the particular retaining bar. In a first embodiment according to the present invention, each locking member of the lid comprises a locking bump. In a second embodiment according to the present invention, each locking member of the lid comprises an angled bar, in which the angle of each angled bar substantially corresponds to the angle of each retaining bar so that abutment of each angled bar with the corresponding retaining bar prevents further rotation of the lid in the first direction.

In the combination according to the present invention, the recessed cylindrical wall of the mug further comprises at least one opening, and the lid further comprises at least one opening. Each opening of the lid is adapted to be substantially aligned with a corresponding opening of the mug for allowing fluid or liquid contained in the mug to flow therethrough when each locking member abuts the lower edge of the particular retaining bar.

In the combination according to the present invention, the lid may be adapted for use as a coaster for the mug. The lid further comprises an annular ledge extending inwardly from the cylindrical side wall, and a concave cover connected to the inner edge of the annular ledge. In addition, the cylindrical body of the mug further comprises an annular curved wall extending gradually inwardly from the lower end of the cylindrical body and a concave base extending radially inwardly and upwardly from the annular curved wall. The annular curved wall of the mug is adapted to rest on the concave cover and annular ledge of the lid when the lid is adapted for use as a coaster for the mug.

In the combination according to the present invention, the mug further comprises a sealing ring attached to the outer surface of the recessed cylindrical wall. The sealing ring is made from a flexible material and has an outer surface adapted to frictionally engage the inner surface of the cylindrical side wall of the lid. In addition, one or more protrusions may be provided on the outer surface of the recessed cylindrical wall and adapted to frictionally engage the inner surface of the cylindrical side wall of the lid.

Therefore, the abutment of the complementary retaining bars and locking members provide an effective mechanism for securing the lid at the mouth of the mug, and operates reliably even when used with ceramic, porcelain or glass mugs that are not always provided in the precise sizes and shapes. The mug and lid according to the present invention is simple in construction and does not contain any fragile components. In addition, the lid may be used as a coaster for the mug.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
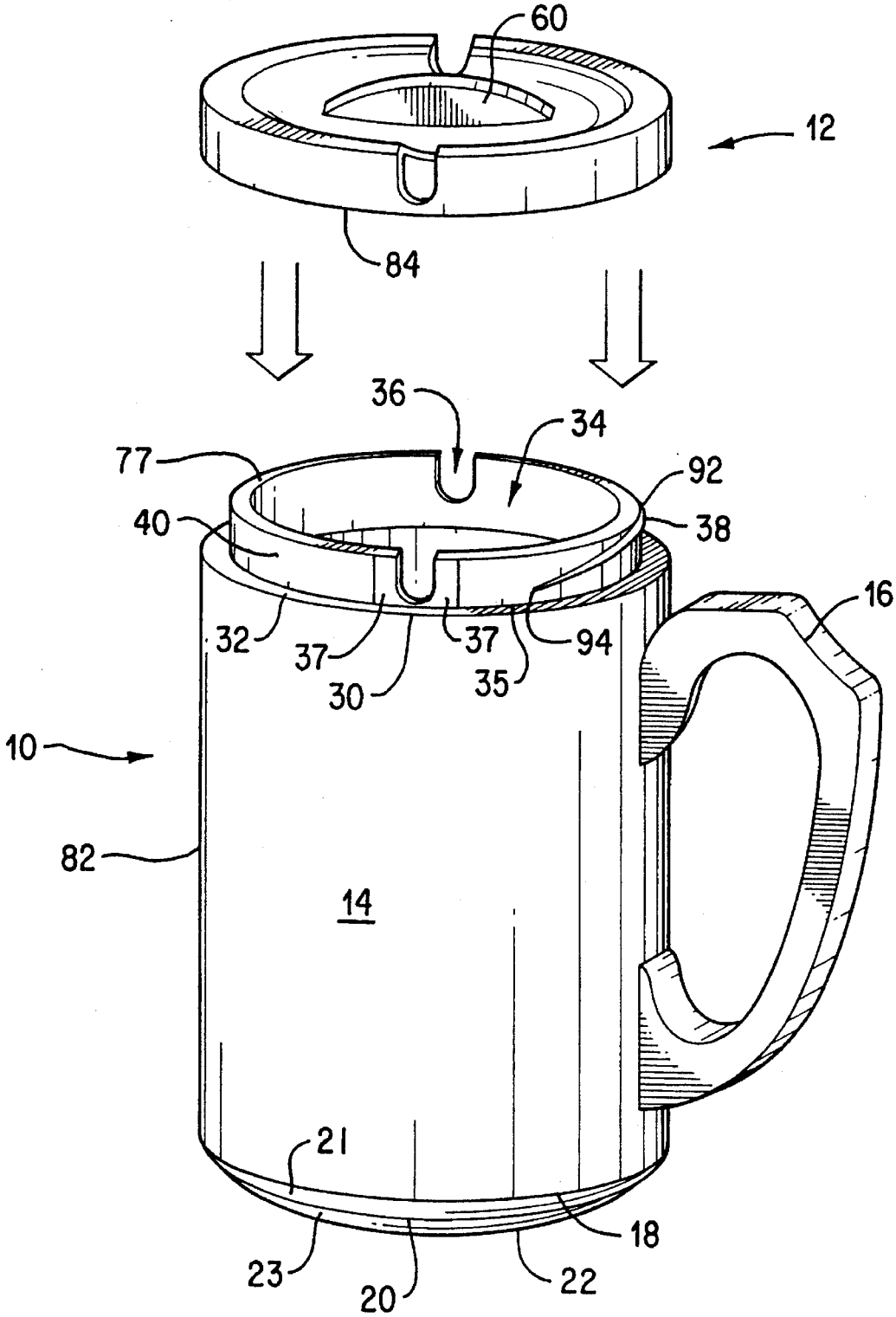
FIG. 1 is an exploded perspective view of a first embodiment of the mug and lid combination of the present invention showing the lid adapted to cover the mouth of the mug.

FIG. 1 illustrates a mug 10 and a multipurpose lid 12 in use in accordance with a first preferred embodiment of the present invention. The mug 10 has a hollow cylindrical body 14 and a handle 16 attached to the body 14.

Figure 4:
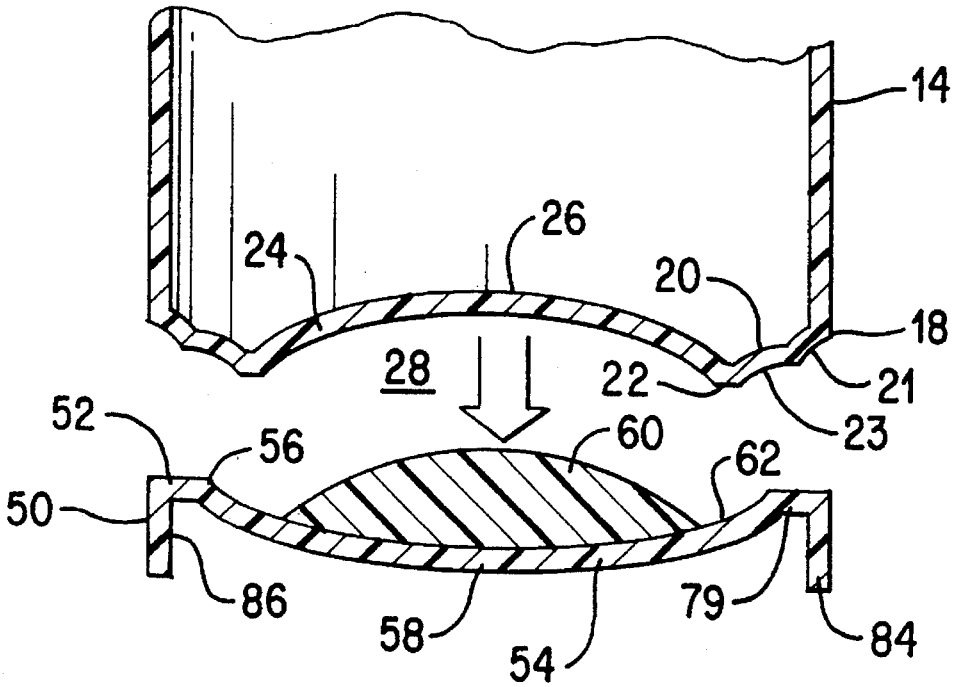
FIG. 4 is an exploded cross-sectional view of the mug and lid combination of FIG. 1 showing the lid adapted for use as a coaster for the mug.

Referring also to FIG. 4, the lower end 18 of the body 14 terminates at an annular curved wall 20. The annular curved wall 20 may comprise a single wall portion that curves gradually and radially inwardly towards the center of the mug 10, or as shown in FIGS. 1 and 4, may also comprise two separate curved wall portions 21 and 23. The lowest point 22 of the annular curved wall 20 is also the lowest point of the mug 10. A concave-shaped base 24 is provided at the lowest point 22 along the annular curved wall 20. The concave base 24 is gradually curved radially and upwardly towards the center of the mug 10 and defines a dome-like enclosure enclosing a space 28 with its central point 26 being the highest vertical point of the concave base 24.

Referring to FIG. 1, the upper end 30 of the mug 10 is provided with an annular shoulder 32 which supports a recessed cylindrical wall 34 at its inner edge 35. The cylindrical wall 34 is recessed from the body 14 in that its diameter is smaller than that of the body 14. A mouth is defined by the upper edge 77 of the cylindrical wall 34. At least one opening 36 is provided in spaced apart manner along the cylindrical wall 34 to allow fluid contained in the mug 10 to pass therethrough. One or more thin protrusions or raised bumps 37 may be provided on both sides of each opening 36 on the outer surface 40 of the cylindrical wall 34, or at any location along the cylindrical wall 34. In addition, as explained in greater detail hereinbelow, at least one retaining bar 38 is attached to the outer surface 40 of the cylindrical wall 34.

The concave base 24, the annular curved wall 20, the annular shoulder 32 and the cylindrical wall 34 are preferably provided integral with the body 14, although it is possible to provide them as separate components and to connect them by using conventional connection methods. In addition, the concave base 24, the annular curved wall 20, and possibly the lower portion of the body 14 may be weighted to provide the mug 10 with more stability when in use. Aside from the above-described features for the concave base 24, the annular curved wall 20, the annular shoulder 32 and the cylindrical wall 34, the shape and size of the body 14 may be varied without departing from the spirit and scope of the present invention.

Figure 2:
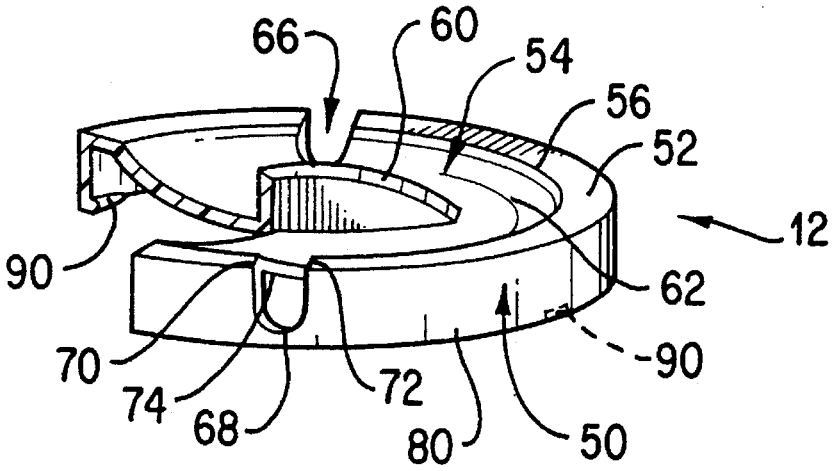
FIG. 2 is a perspective cut-away view of the lid of FIG. 1 with a portion of the lid cut away to illustrate specific features of this lid.

Referring to FIGS. 1, 2 and 4, the lid 12 comprises a substantially cylindrical side wall 50 and an annular ledge 52 extending radially inwardly therefrom. A concave cover 54 is provided at the innermost edge 56 of the ledge 52. The cover 54 curves gradually downwardly as it extends inwardly from the edge 56, such that its lowest point is at about its central point 58. A handle bar 60 is carried at the upper surface 62 of the cover 54. Although the handle bar 60 is illustrated as comprising a simple curved bar, it is understood that handles having other configurations can be provided without departing from the spirit and scope of the present invention.

At least one opening 66 is provided in spaced-apart manner along the lid 12 to allow liquid contained in the mug to pass therethrough for drinking purposes. Each opening 66 is cut from a portion of the side wall 50, the ledge 52 and the cover 54, and is preferably sized and configured to allow a reasonable flow of liquid therethrough. In the preferred embodiment, each opening 66 has a U-shaped edge 68 cut from the side wall 50, two parallel edges 70, 72 cut radially along the corresponding part of the ledge 52, and another U-shaped edge 74 cut from the corresponding part of the cover 54. It is understood that openings having other configurations and sizes can be provided without departing from the spirit and scope of the present invention.

Further, all the elements of the lid 12, including the handle bar 60, cover 54, annular ledge 52 and side wall 50, are preferably provided integrally, although it is also possible to provide these elements separately and to attach them together.

When the lid 12 is used to cover the mouth of the mug 10, the bottom surface 84 of the side wall 50 of the lid 12 is preferably adapted to rest on the annular shoulder 32 of the mug 10. Simultaneously, the upper edge 77 of the cylindrical wall 34 may also be adapted to abut the bottom surface 79 of the lid 12. Alternatively, the upper edge 77 of the cylindrical wall 34 may be adapted to abut the bottom surface 79 of the lid 12 without the bottom surface 84 resting on the annular shoulder 32.

When so positioned, the inner surface 86 of the side wall 50 is positioned adjacent the outer surface 40 of the recessed cylindrical wall 34, and the outer surface 80 of the side wall 50 is preferably substantially flush with the outer surface 82 of the body 14. The thickness of the side wall 50 is also preferably slightly less than the width of the ledge 32, so that the inner surface 86 of the side wall 50 is in close proximity with the outer surface 40 of the recessed cylindrical wall 34, and preferably frictionally engages the protrusions 37. In addition, each opening 66 in the lid 12 should be substantially aligned with a corresponding opening 36 in the recessed cylindrical wall 34, although exact alignment is not necessary. The opening(s) 36 should preferably be of about the same size and configuration as the opening(s) 66 so that liquid contained in the mug 10 can flow uninterrupted therethrough.

In a preferred embodiment of the present invention, two sets of substantially aligned openings 36 and 66 are provided in the mug 10 and the lid 12. However, it will be understood that other modifications may be made to the openings 36, 66 without departing from the spirit and scope of the present invention. For example, at least one set, or more than two sets, of openings 36, 66 may be provided. These sets of openings may be provided anywhere along the lid 12, including, as shown in FIGS. 1 and 2, substantially opposite each other.

The lid 12 may be secured to the mouth of the mug 10 by a set of complementary bars or bumps. Specifically, at least one angled retaining bar 38 is provided on the outer surface 40 of the recessed cylindrical wall 34. In addition, at least one locking protrusion or bump 90 is provided along the inner surface 86 of the side wall 50 adjacent the bottom surface 84. In the first preferred embodiment shown in FIGS. 1 and 2, two retaining bars 38 and two locking bumps 90 are provided, with one bump 90 shown in phantom. In use, the lid 12 is lowered onto the shoulder 32 in a manner such that the locking bumps 90 do not contact the retaining bars 38. The bottom surface 84 of the lid 12 rests on the annular shoulder 32, and even though the inner surface 86 of the side wall 50 is in close proximity to the outer surface 40 of the recessed cylindrical wall 34, a very small gap exists therebetween to allow for relative rotational movement between the lid 12 and the mug 10. The frictional engagement between the protrusions 37 and the inner surface 86 of the side wall 50 is preferably such that it does not prevent rotational movement of the lid 12, but facilitates the rotation while providing a relatively snug fit. The lid 12 is then rotated in the clockwise direction (based on the view of FIG. 1) so that the locking bumps 90 pass below the upper edges 92 of the retaining bars 38. Further rotation of the lid 12 in the clockwise direction will cause the locking bumps 90 to abut the lower edges 94 of the retaining bars 38, which act as stop mechanisms to prevent further rotation of the lid 12 in the clockwise direction. The lid 12 is now secured to the mouth of the mug 10 because the retaining bars 38 will prevent upward movement of the locking bumps 90. To disengage the lid 12, the lid 12 is rotated counter-clockwise to free the locking bumps 90 from the retaining bars 38.

The retaining bars 38 are preferably provided at an angle to the horizontal axis to restrict rotation of the lid 12 in one direction when the locking bumps 90 abut the lower edges 94 of the retaining bars 38. Thus, the user will always know that the lid 12 has been properly secured if clockwise rotation is no longer possible. In addition, the lid 12 is not easily disengaged because the user must rotate the lid 12 in the opposite direction to free the locking bumps 90 from the retaining bars 38. Notwithstanding this, horizontal retaining bars may also be provided without departing from the spirit and scope of the present invention.

In addition, although FIGS. 1 and 2 illustrate the provision of two sets of retaining bars 38 and locking bumps 90, it is understood that only a minimum of one set of retaining bar 38 and locking bump 90 is needed to secure the lid 12 to the mouth of the mug 10. Any number of sets of retaining bars 38 and locking bumps 90 may be provided without departing from the spirit and scope of the present invention. The sets of retaining bars 38 and locking bumps 90 are preferably positioned on the mug 10 and lid 12, respectively, so that the opening(s) 36 and 66 are substantially aligned when the locking bump(s) 90 abut the lower edge 94 of the retaining bar(s) 38.

Figure 3:
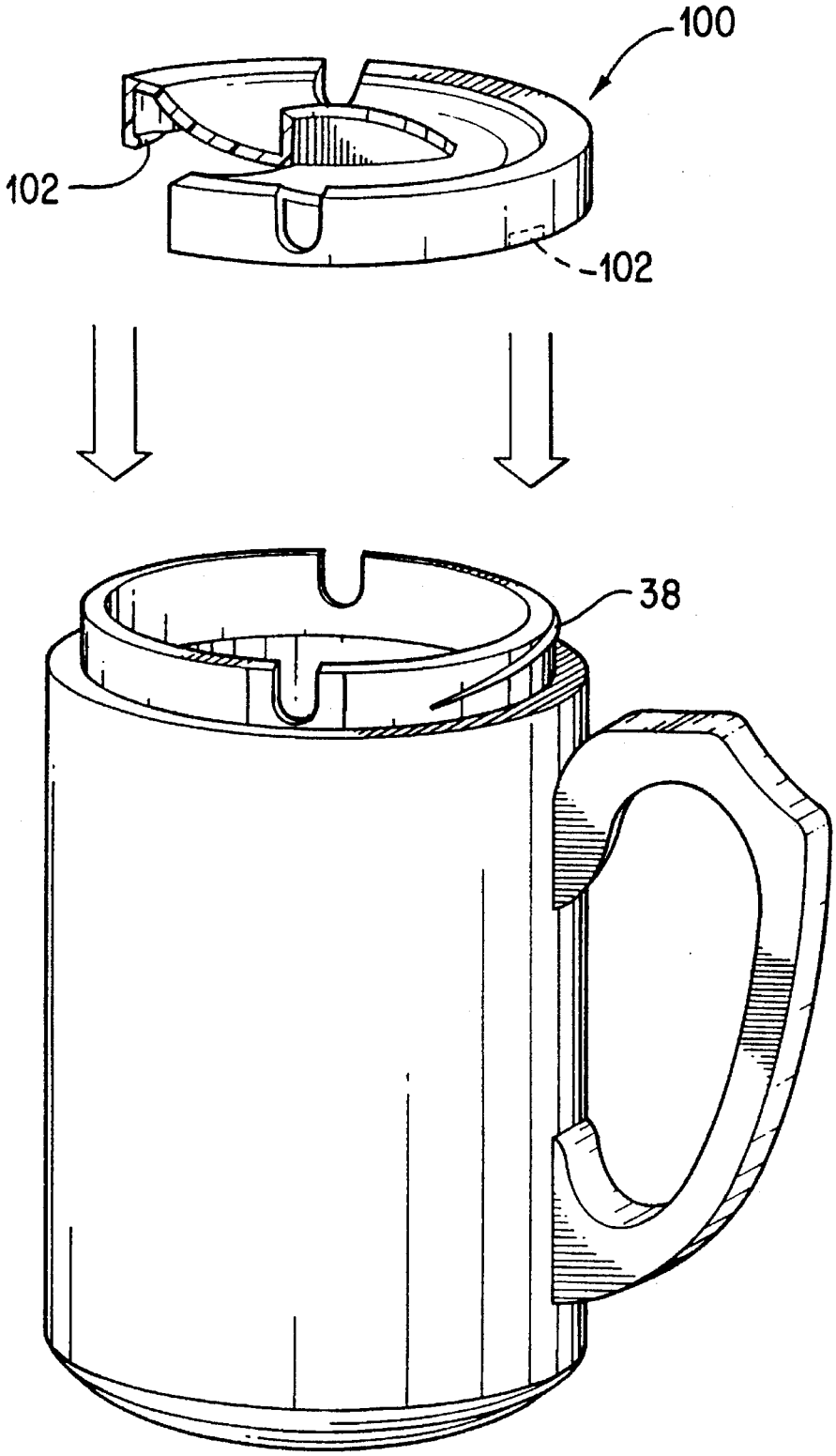
FIG. 3 is an exploded perspective view of a second embodiment of the mug and lid combination of the present invention showing the lid adapted to cover the mouth of the mug, with a portion of the lid cut away to illustrate specific features of this lid.

Instead of locking bumps 90 provided on the inner surface 86 of the side wall 50, other locking or engaging devices may be provided without departing from the spirit and scope of the present invention. For example, referring to FIG. 3, a lid 100 may be provided with angled bars 102 whose angles substantially correspond to those of the retaining bars 38 (one such angled bar 102 is shown in phantom). The structure and use of the lid 100 is similar to that of the lid 12. The lid 100 is lowered onto the shoulder 32 in a manner such that the angled bars 102 do not contact the retaining bars 38. The lid 100 is then rotated in the clockwise direction (based on the view of FIG. 3) so that the angled bars 102 abut the retaining bars 38, at which point further rotation is impeded. The corresponding angles of the bars 38 and 102 facilitate the abutment. At this position, the retaining bars 38 prevent upward movement of the angled bars 102 to secure the lid 100 to the mug 10. To disengage the lid 100, the lid 100 is rotated counter-clockwise to free the angled bars 102 from the retaining bars 38.

The angle of the retaining bars 38 and the angled bars 102 preferably range from about 15 to 45 degrees from the horizontal axis. The angles can be varied without departing from the spirit and scope of the present invention. Depending on the angle of the bars 38 and/or 102, the rotation of the lids 12 and 100 may need to be in either the clockwise or the counter-clockwise direction to accomplish the engagement.

Figure 5:
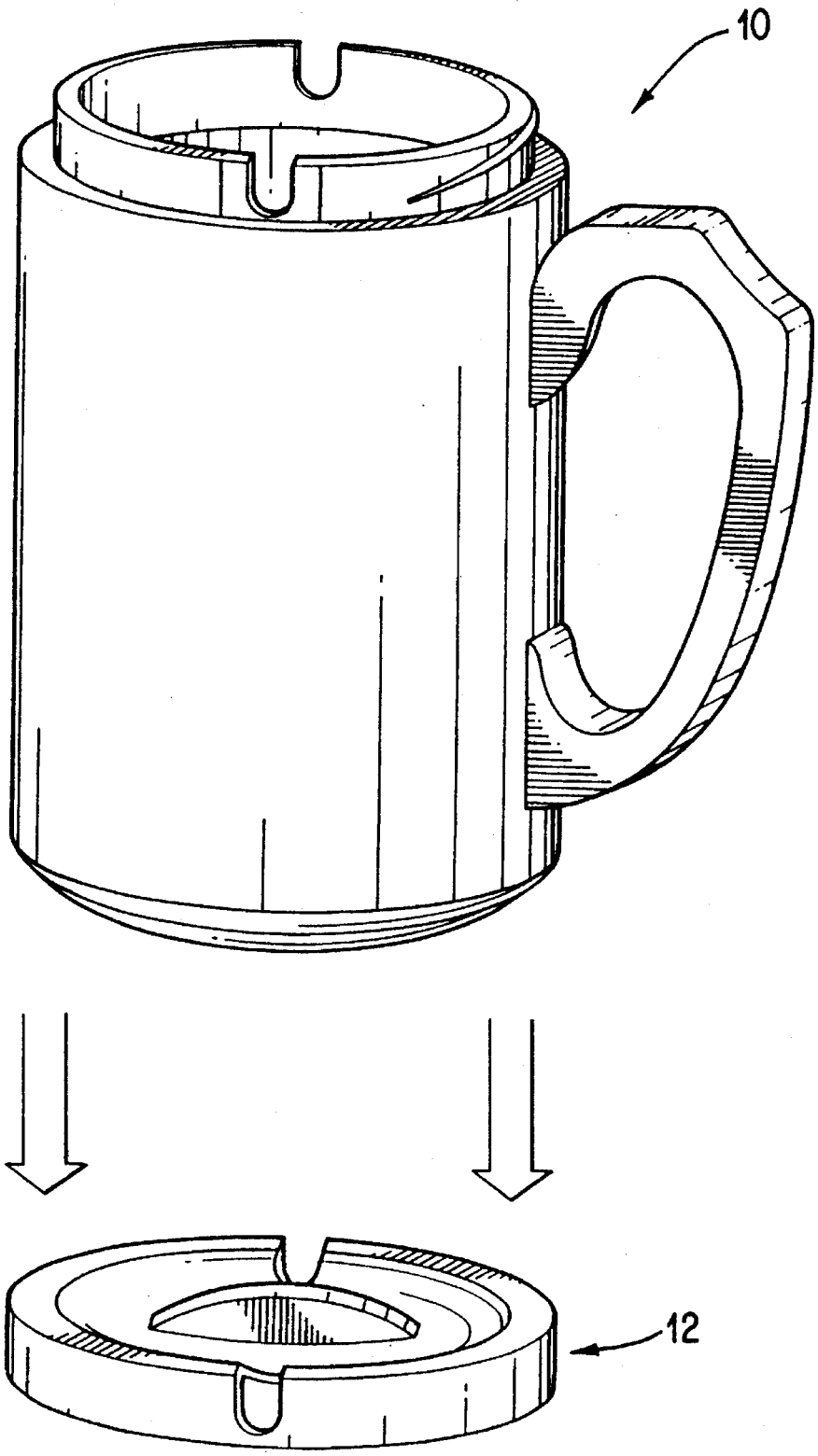
FIG. 5 is an exploded perspective view of the mug and lid combination of FIG. 1 showing the lid adapted for use as a coaster for the mug.

Referring to FIGS. 4 and 5, the lid 12 can also be used as a coaster for the mug 10. The annular curved wall 20 and concave base 24 of the mug 10 are correspondingly configured so that the annular curved wall 20 is adapted to rest on the curved upper surface 62 of the cover 54 and annular ledge 52, and the space 28 defined by the concave base 24 allows the curved handle bar 60 to be fitted therein. More specifically, the wall portion 23 rests on the inner edge 56 of the annular ledge 52. The support provided by the cover 54 and annular ledge 52 of the lid 12 to the annular curved wall 20 of the mug 10 provides stability to the mug 10 when seated on the lid 12 acting as a coaster.

Figure 6:
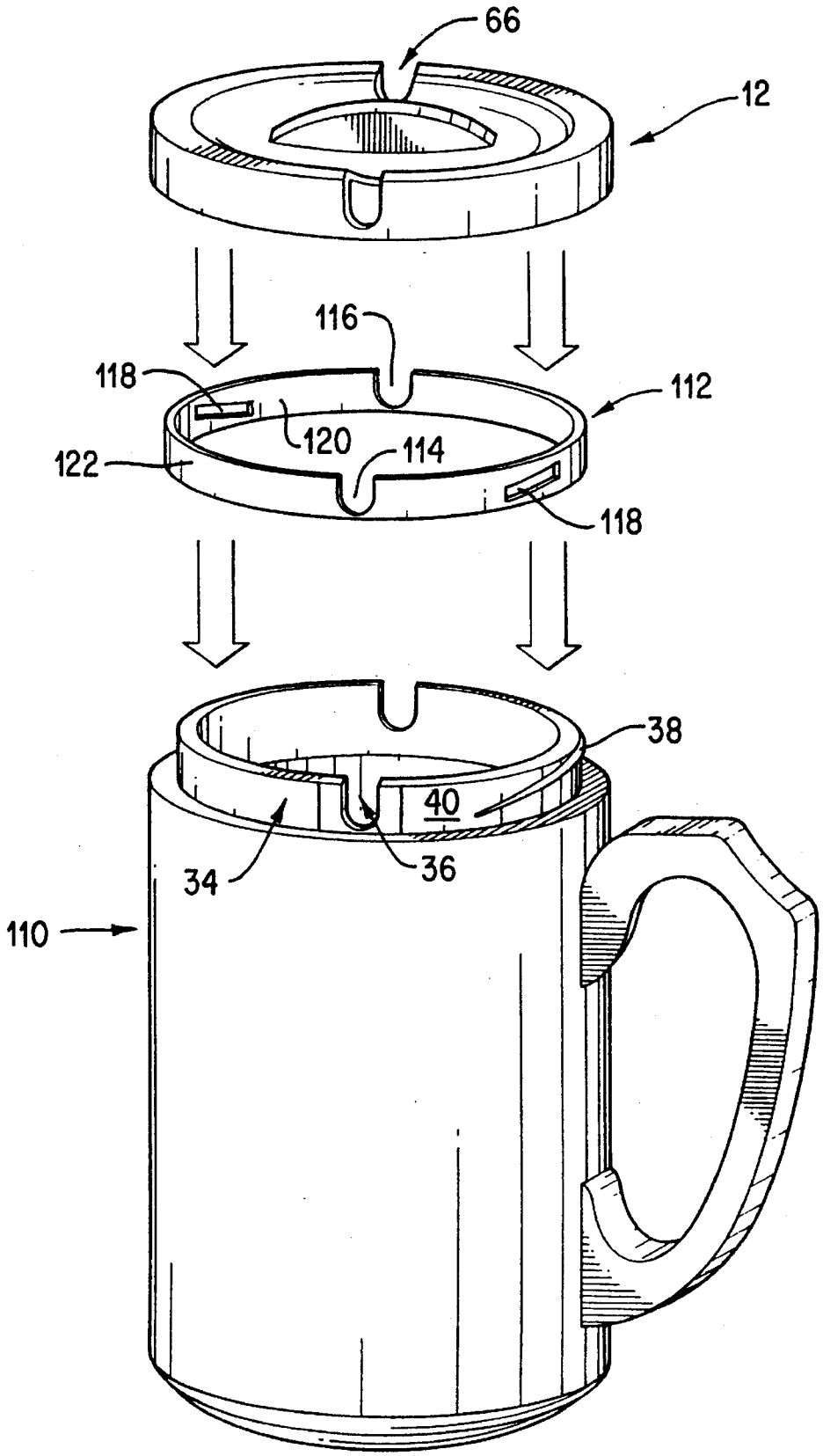
FIG. 6 is an exploded perspective view of the lid of FIG. 1 in use with another embodiment of a mug according to the present invention.

Referring now to FIG. 6, another preferred embodiment of the mug 110 is illustrated. The mug 110 is the same as the mug 10 of FIGS. 1, 3, 4 and 5, but additionally comprises a substantially circular sealing ring 112 attached to the outer surface 40 of recessed cylindrical wall 34. Openings 114 and 116 corresponding to the openings 36, 66, and slots 118 corresponding to the retaining bars 38 for accommodating the retaining bars 38, are provided in the sealing ring 112. The material of the sealing ring 112 has a resiliency which holds the sealing ring 112 tightly against the recessed cylindrical wall 34. The sealing ring 112 has an inner surface 120 attached to the recessed cylindrical wall 34 and an outer surface 122 adapted to frictionally engage the internal surface 86 of the side wall 50 of the lid 12 to additionally secure the lid 12 to the mug 10. The sealing ring 112 is preferably made from a resilient and flexible non-toxic material such as but not limited to rubber, silicon, or polyethylene. Alternatively, instead of the sealing ring 112, a plurality of strips of sealing material (not shown) made from the same material as the sealing ring 112 may be attached to the outer surface 40 of the recessed cylindrical wall 34. The construction and use of such a sealing ring 112 and the plurality of strips of material are taught in greater detail in U.S. Pat. No. 5,368,186 to Yeh, the entire disclosure of which is incorporated by this reference as though fully set forth herein. The use of the sealing ring 112 may be applied to any of the lids described herein.

The protrusions 37 may be provided instead of or together with the sealing ring 112. Both the sealing ring 112 and the protrusions 37 are adapted to provide a snug fit between the lid 12 and the mouth of the mug 10. Therefore, the protrusions 37 may be omitted without departing from the spirit or scope of the present invention.

The mug 10 and the lids 12 and 100 can be made from the same or different materials. The mug 10 is preferably made from ceramic but may also be made from plastic, porcelain, glass or other similar material. The lids 12 and 100 are preferably made from a non-toxic material such as ceramic, glass, porcelain, polypropylene, polyethylene, wood or bamboo which is suitable for use both as a lid and as a coaster. The abutment between the locking bumps 90 or angled bars 102 and the retaining bars 38 is simple and effective, and operates reliably even when used with ceramic, porcelain or glass mugs that are not provided in the precise sizes and shapes. The mug and lid according to the present invention is simple in construction and does not contain any fragile components, and it is anticipated that the mug and lid, and their securing mechanisms, will be durable. In addition, the lid may be used as a coaster for the mug.

While the description above refers to particular embodiments of the present invention, it will be understood that many modifications may be made without departing from the spirit thereof.

What is claimed is:

1. A drinking mug and lid combination, comprising:

a. a lid comprising a substantially cylindrical side wall having an inner surface, and at least one locking member provided on the inner surface; and b. a mug comprising a substantially cylindrical body having an upper end, an annular shoulder provided at the upper end of the cylindrical body and having an inner edge, and a recessed cylindrical wall at the inner edge of the annular shoulder defining a mouth, the recessed cylindrical wall having an outer surface, and at least one opening provided in the outer surface, with the recessed cylindrical wall having a smaller diameter than that of the cylindrical body, the mug further comprising at least one retaining bar provided on the outer surface of the recessed cylindrical wall and at least one protrusion provided on the outer surface of the recessed cylindrical wall adjacent the at least one opening for frictional engagement with the inner surface of the cylindrical side wall of the lid;

c. wherein the inner surface of the cylindrical side wall of the lid is positioned adjacent the outer surface of the recessed cylindrical wall of the mug when the lid is used to cover the mouth of the mug, and wherein the lid is rotated in a first direction so that each locking member of the lid is retained below each corresponding retaining bar of the mug to secure the lid to the mouth of the mug.

2. The combination of claim 1, wherein each retaining bar of the mug is angled, and wherein each retaining bar acts to stop advancement of a corresponding locking member of the lid in the first direction when the locking member abuts the particular retaining bar.

3. The combination of claim 2, wherein each retaining bar of the mug further comprises an upper edge and a lower edge, and wherein the lower edge of each retaining bar acts to stop advancement of a corresponding locking member of the lid in the first direction when the locking member abuts the lower edge of the particular retaining bar.

4. The combination of claim 3, wherein the at least one locking member of the lid comprises at least one locking bump.

5. The combination of claim 2, wherein the lid further comprises at least one opening, wherein each opening of the lid is substantially aligned with each opening of the mug for allowing fluid contained in the mug to flow therethrough.

6. The combination of claim 5, wherein each opening of the lid is substantially aligned with a corresponding opening of the mug when each locking member abuts the corresponding retaining bar.

7. The combination of claim 2, wherein the at least one locking member of the lid comprises at least one angled bar, and wherein the angle of each angled bar substantially corresponds to the angle of each retaining bar so that abutment of each angled bar with the corresponding retaining bar prevents further rotation of the lid in the first direction.

8. The combination of claim 2, wherein the lid further comprises an annular ledge extending inwardly from the cylindrical side wall, the ledge having an inner edge, and wherein the lid further comprises a concave cover connected to the inner edge of the annular ledge.

9. The combination of claim 8, wherein the cylindrical body of the mug further comprises a lower end, and the mug further comprises an annular curved wall extending gradually inwardly from the lower end of the cylindrical body and a concave base extending radially inwardly and upwardly from the annular curved wall.

10. The combination of claim 9, wherein the annular curved wall of the mug rests on the concave cover and annular ledge of the lid when the lid is used as a coaster for the mug.

11. The combination of claim 2, wherein the mug further comprises a sealing ring attached to the outer surface of the recessed cylindrical wall.

12. The combination of claim 11, wherein the sealing ring is made from a flexible material and has an outer surface for frictional engagement with the inner surface of the cylindrical side wall of the lid.

13. A drinking mug and lid combination, comprising:

a. a lid comprising a substantially cylindrical side wall having an inner surface, at least one locking member provided on the inner surface, and a substantially flat annular ledge extending inwardly from the cylindrical side wall, the ledge having an inner edge, and wherein the lid further comprises a substantially concave cover connected to the inner edge of the annular ledge, and a substantially convex handle extending vertically from the concave cover; and b. a mug comprising a substantially cylindrical body having an upper end and a lower end, an annular shoulder provided at the upper end of the cylindrical body and having an inner edge, and a recessed cylindrical wall at the inner edge of the annular shoulder defining a mouth, the recessed cylindrical wall having an outer surface and a smaller diameter than that of the cylindrical body, the mug further comprising at least one retaining bar provided on the outer surface of the recessed cylindrical wall, an annular curved transition wall extending inwardly from the lower end of the cylindrical body and a concave base extending radially inwardly and upwardly from the transition wall and defining a space therein;

c. wherein the transition wall of the mug rests on the concave cover and annular ledge of the lid, and the convex handle of the lid fits inside the space defined by the concave base of the mug when the lid is used as a coaster for the mug.

14. The combination of claim 13, wherein the inner surface of the cylindrical side wall of the lid is positioned adjacent the outer surface of the recessed cylindrical wall of the mug when the lid is used to cover the mouth of the mug, and wherein the lid is rotated in a first direction so that each locking member of the lid is retained below each corresponding retaining bar of the mug to secure the lid to the mouth of the mug.

15. The combination of claim 14, wherein the recessed cylindrical wall of the mug further comprises at least one opening, and the lid further comprises at least one opening, wherein each opening of the lid is substantially aligned with each opening of the mug for allowing fluid contained in the mug to flow therethrough.

16. The combination of claim 15, wherein the mug further comprises at least one protrusion provided on the outer surface of the recessed cylindrical wall adjacent the at least one opening for frictionally engaging the inner surface of the cylindrical side wall of the lid.

17. The combination of claim 14, wherein each retaining bar of the mug is angled, and wherein each retaining bar acts to stop advancement of a corresponding locking member of the lid in the first direction when the locking member abuts the particular retaining bar.

18. The combination of claim 17, wherein each retaining bar of the mug further comprises an upper edge and a lower edge, and wherein the lower edge of each retaining bar acts to stop advancement of a corresponding locking member of the lid in the first direction when the locking member abuts the lower edge of the particular retaining bar.

19. The combination of claim 17, wherein the at least one locking member of the lid comprises at least one angled bar, and wherein the angle of each angled bar substantially corresponds to the angle of each retaining bar so that abutment of each angled bar with the corresponding retaining bar prevents further rotation of the lid in the first direction.

20. The combination of claim 13, wherein the mug further comprises a sealing ring attached to the outer surface of the recessed cylindrical wall and having an outer surface for frictionally engaging the inner surface of the cylindrical side wall of the lid.

* * * * *